US005134872A

United States Patent [19]

Ose

[11] Patent Number: 5,134,872

[45] Date of Patent: Aug. 4, 1992

[54] TUBE END EXPANDER DEVICE

[75] Inventor: Paul N. Ose, St. Anthony, Minn.

[73] Assignee: Air-Mo Hydraulics Inc., Minneapolis, Minn.

[21] Appl. No.: 707,426

[22] Filed: May 28, 1991

Related U.S. Application Data

[63] Continuation of Ser. No. 517,814, Apr. 2, 1990, abandoned.

[51] Int. Cl.[5] ..... B21D 11/00

[52] U.S. Cl. ..... 72/318; 72/316; 72/312

[58] Field of Search ..... 72/316, 317, 318, 391.2, 72/370, 61, 75, 312; 29/237, 244, 252, 280, 283.5

[56] References Cited

U.S. PATENT DOCUMENTS

| | | | |
|---|---|---|---|
| 2,438,999 | 4/1948 | Hartley et al. | 72/316 |
| 2,465,677 | 3/1949 | Deverall | 72/316 |
| 2,654,414 | 10/1953 | Tomarin | 72/318 |
| 2,998,125 | 8/1961 | Hahn et al. | 72/318 |
| 3,021,546 | 2/1962 | Yowell et al. | 72/370 |
| 3,143,989 | 8/1964 | Hermanns | 72/370 |
| 3,505,846 | 4/1970 | Smida | 72/61 |
| 3,568,303 | 3/1971 | Ito et al. | 72/370 |
| 3,820,375 | 6/1974 | Koski | 73/318 |

*Primary Examiner*—Lowell A. Larson
*Assistant Examiner*—Michael J. McKeon
*Attorney, Agent, or Firm*—John S. Munday

[57] ABSTRACT

A hydraulic chuck device for enlarging the end of a tube, which includes a chuck body having first and second inlets for a source of fluid under pressure. The device has a tube receiving end where the tube to be enlarged is inserted. Also included is a piston mounted in the body which is adapted to move toward the tube receiving end upon introduction of fluid under pressure to the first inlet and away from the tube receiving end upon introduction of fluid under pressure to the second inlet. The piston has a tube engaging sizing ball on one end for enlarging a tube inserted into the tube receiving end of the body when the piston moves toward that end. Also provided are collets mounted in the body at the receiving end to engage the tube and prevent movement thereof with respect to the body. The collets are cooperatively attached to the piston to engage and release the tube as the piston moves toward and away from the tube receiving end.

4 Claims, 1 Drawing Sheet

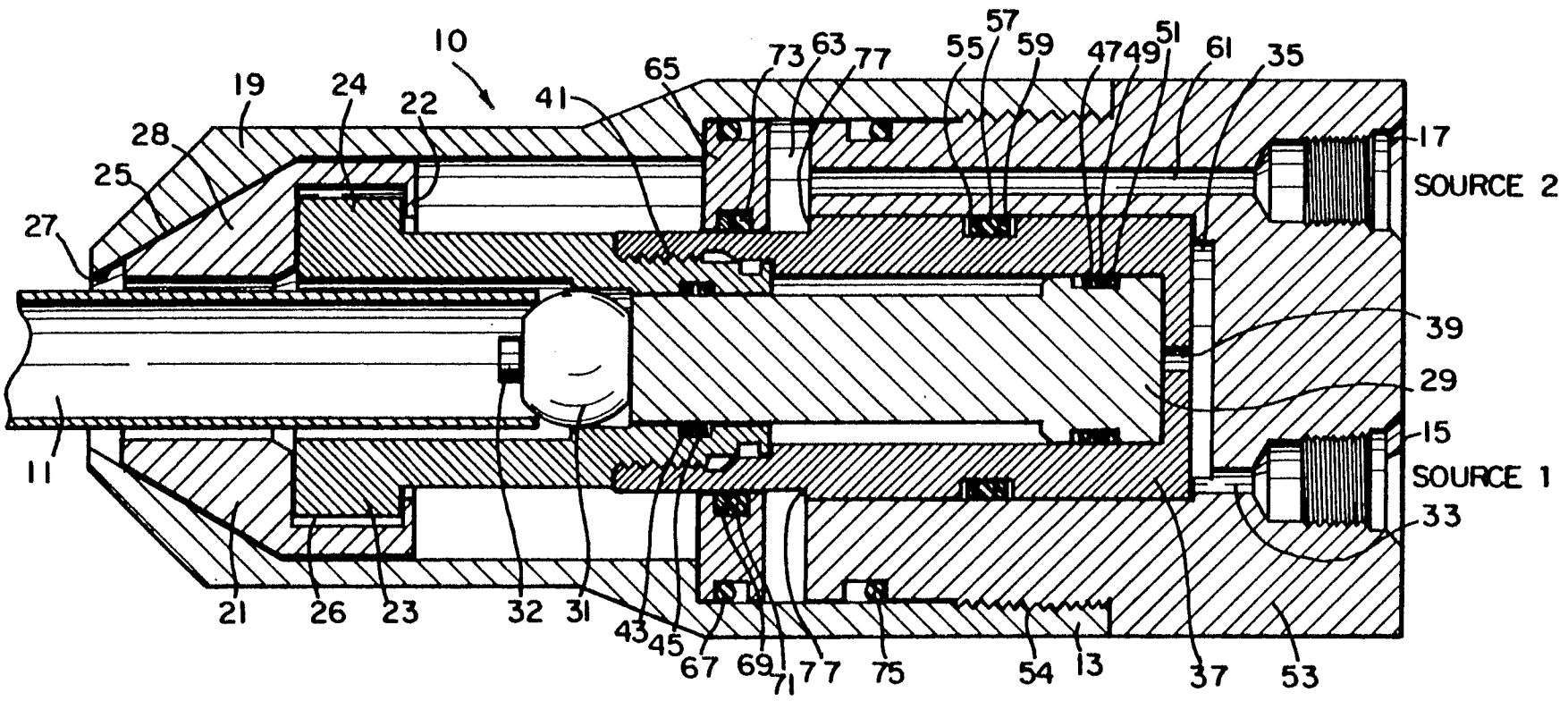
SOURCE 2
SOURCE 1
17
39
29
15
33
35
61
51
49
47
59
57
55
77
63
73
65
41
10
22
24
19
28
25
27
11
53
37
13
54
75
77
71
69
67
45
43
31
32
23
26
21

TUBE END EXPANDER DEVICE

This is a continuation of copending application Ser. No. 07/517,814 filed on Apr. 2, 1990, now abandoned.

FIELD OF THE INVENTION

This invention relates to a tube end expander, and more particularly to a hydraulic chuck device for expanding the end of a tube such as those tubes used in air conditioning coils.

BACKGROUND OF THE INVENTION

Fluid pressure devices operated by hydraulic pressure or pneumatic pressure are known, particularly for expanding tubes such as those used in air conditioning coils and the like. Several hydraulic devices have been developed which are suitable for tightly gripping one end of an elongated tube while simultaneously delivering a tube expanding fluid. Among these are U.S. Pat. Nos. 3,505,846; 3,813,751, 3,962,769; and 4,189,162. None of these patents describe devices which are suitable for expanding the ends of tubes.

One of the problems which is encountered in the assembly of tube devices is the need to quickly and efficiently join tubes together, either when the unit is assembled in the field or when repairs are made. Even in factory assembly, coil units require tubes to be joined and this procedure needs to be accomplished as effectively and efficiently as possible.

The only prior art devices which are used currently to expand the ends of tubes are devices which include a split finger means which is inserted in the tube. As the split fingers expand or flair out the end of the tube, material is squeezed between the fingers, leaving longitudinally extending ridges or raised portions. These raised portions of material cause several problems, both in obtaining a good junction and strong seal, and in requiring the use of much more silver solder or other sealing material.

Accordingly, it would be of great advantage in the art if a means could be provided for expanding the ends of tubes without causing the tube to be pinched or otherwise deformed during the expansion process. It is an object of this invention to provide a device for obtaining this advantage.

Another advantage in the art would be obtained if the ends of tubes could be expanded using a simple, effective device which can accommodate tubes of different thicknesses. At the present, split finger devices are not effectively adjustable to accommodate different tube wall thicknesses. This is also an object of this invention, to provide a device which can easily be adjusted for tubes of different wall thicknesses.

Other objects will appear hereinafter.

SUMMARY OF THE INVENTION

It has now been discovered that the above and other objects of the present invention may be accomplished in the following. Specifically, a hydraulic chuck has been discovered which comprise a plurality of parts in interworking relationship which accomplish the above and other described objects.

The hydraulic chuck of this invention comprises a chuck device for enlarging the end of a tube, which includes a chuck body having first and second inlets for a source of fluid under pressure. The device has a tube receiving end where the tube to be enlarged is inserted.

Also included is a piston mounted in the body which is adapted to move toward the tube receiving end upon introduction of fluid under pressure to the first inlet and away from the tube receiving end upon introduction of fluid under pressure to the second inlet. The piston has a tube engaging sizing means on one end for enlarging a tube inserted into the tube receiving end of the body when the piston moves toward that end.

Also provided are collets mounted in the body at the receiving end to engage the tube and prevent movement thereof with respect to the body. The collets are cooperatively attached to the piston to engage and release the tube as the piston moves toward and away from the tube receiving end.

In a preferred embodiment, the hydraulic fluid is introduced to the first inlet which provides fluid access to a first expansion chamber. This chamber is preferably located axially behind the piston means, so that an axially centered force can be applied to the sizing means, which in turn provides an axially centered force on the tube end as it is expanded.

The tube grabbing collets are expanded to grab the tube at the tube receiving end by action of the fluid in the first expansion chamber. As pressure is increased in this chamber, the collet means are activated by movement of the piston axially toward the tube. Collet actuators slide the collets axially toward the tube, and the ends of the collets engage an interior surface of the front end of the body which translates axial movement of the collet into radial movement, whereby the collets engage and grip the tube. As more fluid pressure is provided, the grip becomes stronger. The tube engaging surface of the collets is appropriate for tube gripping.

In another preferred embodiment, the sizing means consists of a ball which is axially centered on and removably attached to the piston. Different diameter balls can be used to accommodate different tube wall thicknesses, to provide the same desired outside diameter of the flair or expansion in each case. This allows for quick changes of the ball to adjust for different tube wall thicknesses while insuring uniform outside diameter for uniform assembly and interchangeablility.

In yet another preferred embodiment, the hydraulic fluid is introduced to the second inlet by a port which provides fluid access to a second expansion chamber. This chamber is preferably located axially in front of the piston means, so that an axially centered force can be applied to the piston means to remove the sizing ball and release the collets by moving the piston away from the tube. A pressure plate is provided which does not move with respect to the tube and the front end of the chuck body.

It is also preferred to include various seals and backup means to control the flow of fluid between the particular parts of the device and to permit some degree of lubrication at junctions of parts where movement takes place.

BRIEF DESCRIPTION OF THE DRAWINGS

For a more complete understanding of the invention, reference is hereby made to the drawings, in which:

The FIGURE is a sectional view of a side elevation of a hydraulic chuck device of the present invention, with the section taken along the center axis of the chuck device.

DETAILED DESCRIPTION OF THE INVENTION

As shown in the FIGURE, the device is shown generally by reference numeral 10 and is sized generally to accommodate a tube 11. The tube body 13 is of a size to accept a source of fluid under pressure from a first source into inlet 15 and from a second source into inlet 17. The two inlets 15 and 17 may be connected to the same or different fluid sources, and either or both may be hydraulic or pneumatic, although the preferred embodiment employs hydraulic fluid.

The front end 19 of the body 13 encloses the collet means which includes collets 21 and collet actuators 23. Collets 21 include an annular ring 22 which extends radially inward to cooperate with an annular radially outwardly facing projection 24 on actuator 23. The ring 22 and projection 24 cooperate to move the collets 21 when the actuator 23 is moved axially.

The collets 21 have a radially inwardly tapered surface 25 which encounters a similarly tapered surface 27 on the inside of front end 19 of body 13. The surfaces 25 and 27 cooperate to translate axial movement toward the tube 11 into radial movement of the collet 21 into the tube 11. This radially inward force is sufficient to hold the tube 11 in the collets 21. A space 26 between the collet 21 and the projection 24 is provided to accommodate movement radially inward by the collet 21 as its surface 25 slides down surface 27. Collet face 28 may be provided with gripping teeth or other means for assisting in non-slip engagement of the tube 11 by the collet 21.

The body 13 also encloses a primary piston 29. Piston 29 is fitted with a sizing ball 31 on the end facing the tube 11, and the ball 31 is attached by a cap screw 32 which permits easy and rapid removal of one ball 31 and installation of another ball of a different size.

It is desirable to expand the end of the tube 11 to a constant outside diameter regardless of the thickness of the tube 11. Thus, for example, a ⅝ inch tube may have a wall thickness of 0.065 inches, while another ⅝ inch tube used for different purposes will have a wall thickness of only 0.032 inches. The former tube will require a smaller ball to achieve the same outside diameter after the end has been expanded.

Fluid from the first source enters the body at inlet 15 and is transferred by port 33 to a chamber 35. Chamber 35 is defined by the body 13 and an actuator piston 37, and includes a port 39 for communication with piston 29. Activator piston 37 is threaded at 41 to the collet actuator 23.

The actuator piston 37 is slideably engaged with the piston 29 with backing ring 43 and an o-ring seal 45 at the tube end of piston 29 and at the end near chamber 35 with backing ring 47, o-ring 49 and backing ring 51.

Also part of the body 13 is an end cap 53 which is threaded to the body at threads 54 and which in fact forms the part of body 13 which accommodates inlet ports 15 and 17. The end cap 53 is slideably mounted on the actuator piston 37 with backup ring 55, o-ring 57 and backup ring 59.

Each of these sealing means, with backup rings and o-rings, provides for lubricated sliding movement of the parts of the device to which they are associated. Other seal means can be used for the same purposes.

The end cap 53 of body 13 is also provided with a port 61 to receive fluid from the second source at inlet port 17. Fluid is transferred to chamber 63, where increased pressure will act on the pressure plate 65 which is mounted in relation to body 13 so that plate 65 will not move toward the front end 19 of the body 13.

An o-ring seal 67 is provided to seal between the body 13 and the plate 65. Also, a backup ring 69 and o-ring 71 act to seal between the actuator piston 37 and the pressure plate 65, as these two elements are slideably engaged as described above. Two other o-ring seals 73 and 75 are provided to seal between the collet actuator 23 and actuator piston 37, and the body 13 and end cap 53, respectively as shown.

When fluid enters chamber 63 from inlet port 61, pressure acts on pressure plate 65, which cannot move with respect to end 19, and on the annular surface 77 of actuator piston 37. Since end cap 53 is threaded to body 13 and it also does not move with respect to plate 65, the actuator piston 37 is forces away from the end 19 of body 13 which pressure is exerted on annular surface 77. This force causes actuator piston 37 to slide away from the tube 11, thereby pulling the collet actuator 23 and releasing collet 21.

In operation, the device of this invention is fitted to a tube 11. Fluid pressure is introduced into chamber 35 from a first source of fluid pressure through inlet port 15 and port 33. Pressure in chamber 35 causes the piston actuator 37 to move collet actuator 23 and collet 21, to thereby grab tube 11 as collet surface 25 slides on body end 19 at surface 27. Increased pressure then forces piston 29 and ball 31 to expand the tube end as desired.

When this is accomplished, the pressure in inlet port 15 and chamber 35 is released. Fluid pressure from a second source is introduced through inlet port 17 and port 61 to chamber 63. Pressure in chamber 63 causes the piston 29 and ball 31 to be removed from the expanded end of tube 11, and also causes piston actuator 37 to release collets 21 as described above.

While the invention has been shown with regard to one preferred embodiment, it is intended that modifications and changes can be made as long as they are encompassed by the following claims. Having thus described the invention, what is claimed is:

Having thus described the invention, what is claimed is:

1. A hydraulic chuck for enlarging the outside diameter of an end of a tube independent of the inside diameter of the tube, comprising:

a chuck body having first and second inlet means for a source of fluid under pressure and having a tube receiving end;

a piston mounted in said body and adapted to move toward said tube receiving end upon introduction of fluid under pressure to said first inlet and away from said tube receiving end upon introduction of fluid under pressure to said second inlet, said piston having removable tube engaging sizing ball means on one end for enlarging the outside diameter of the end of a tube inserted into said tube receiving end of said body when said piston moves toward said end, including means limiting the maximum size of expansion of said outside diameter, said sizing ball means including a plurality of sizing balls sized to fit the inside diameter of specific tubes independent of the outside diameter; and collet means mounted in said body at said receiving end to engage said tube at a point spaced from the end to be expanded and prevent movement thereof with respect to said body, said collet being cooperatively attached to said piston to engage and release said tube as said piston moves toward and away from said tube receiving end;

said device including a first expansion chamber connected to said first inlet and positioned to provide axially centered force moving said sizing means toward said tube to expand the outside diameter of said tube end and a second expansion chamber connected to said second inlet means and positioned axially between a portion of said piston and said sizing means to provide axially centered force moving said sizing means away from said tube.

2. The device of claim 1, wherein said collet means engage said tube upon increased pressure in said first chamber and release said tube upon increased pressure in said second chamber.

3. The device of claim 1, which includes means to translate axial movement of said piston to radial movement of said collet, wherein said collet means and said body having cooperating conical surfaces to accomplish said translation.

4. The device of claim 1, which includes seal means between those parts of said device which move with said piston and those parts of said device which do not move with said piston.

* * * * *